US006962309B1

(12) United States Patent
Chang

(10) Patent No.: US 6,962,309 B1
(45) Date of Patent: Nov. 8, 2005

(54) KITE SLIDER

(76) Inventor: Chin-Chuan Chang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/781,584

(22) Filed: Feb. 1, 2004

(51) Int. Cl.[7] ..... B64C 31/06
(52) U.S. Cl. ..... 244/155 R; 446/30; 446/34
(58) Field of Search ..... 244/155 R; 446/30, 446/34

(56) References Cited

U.S. PATENT DOCUMENTS 1,620,991 A * 3/1927 Brown ..... 244/155 R
2,535,165 A * 12/1950 Shoemaker ..... 244/155 R
3,208,697 A * 9/1965 Bayha ..... 244/155 R
3,227,404 A * 1/1966 Scharge ..... 244/155 R
3,596,857 A * 8/1971 Battles ..... 244/155 A

* cited by examiner

*Primary Examiner*—J. Woodrow Eldred
(74) *Attorney, Agent, or Firm*—Alan D. Kamrath; Nikolai & Mersereau, P.A.

(57) ABSTRACT

A kite slider has a base frame and a flying device engaging with the base frame. The base frame has a hollow casing, a winding rod inserted through the hollow casing, and a connection rod connected to the winding rod and extending outward from the hollow casing. An end ring is disposed on the connection rod. A retainer device is connected to the hollow casing and a distal end of the winding rod. A distal ring is disposed on the winding rod. The hollow casing has a retaining notch. The flying device has a main frame, a pair of leaf blades connected to the main frame, a click frame connected to the leaf blades, and a hooking device disposed on the main frame. The click frame engages with the retaining notch of the hollow casing.

2 Claims, 4 Drawing Sheets

KITE SLIDER

The present invention relates to a kite slider, and more particularly to a kite slider which moves along a kite string reciprocatively.

BACKGROUND OF THE INVENTION

A conventional kite has a kite string which is connected to a kite sheet. However, the conventional kite does not have any kite slider to move along the kite string.

SUMMARY OF THE INVENTION

An object of the present invention is to provide a kite slider which moves along a kite string reciprocatively so that a user will feel curious while the kite slider moves along a kite string reciprocatively.

Accordingly, a kite slider comprises a base frame and a flying device engaging with the base frame. The base frame has a hollow casing, a winding rod inserted through the hollow casing, and a connection rod connected to the winding rod and extending outward from the hollow casing. An end ring is disposed on the connection rod. A retainer device is connected to the hollow casing and a distal end of the winding rod. A distal ring is disposed on the winding rod. The hollow casing has a retaining notch. The flying device has a main frame, a pair of leaf blades connected to the main frame, a click frame connected to the leaf blades, and a hooking device disposed on the main frame. The click frame engages with the retaining notch of the hollow casing.

DETAILED DESCRIPTION OF THE INVENTION

Figure 1:
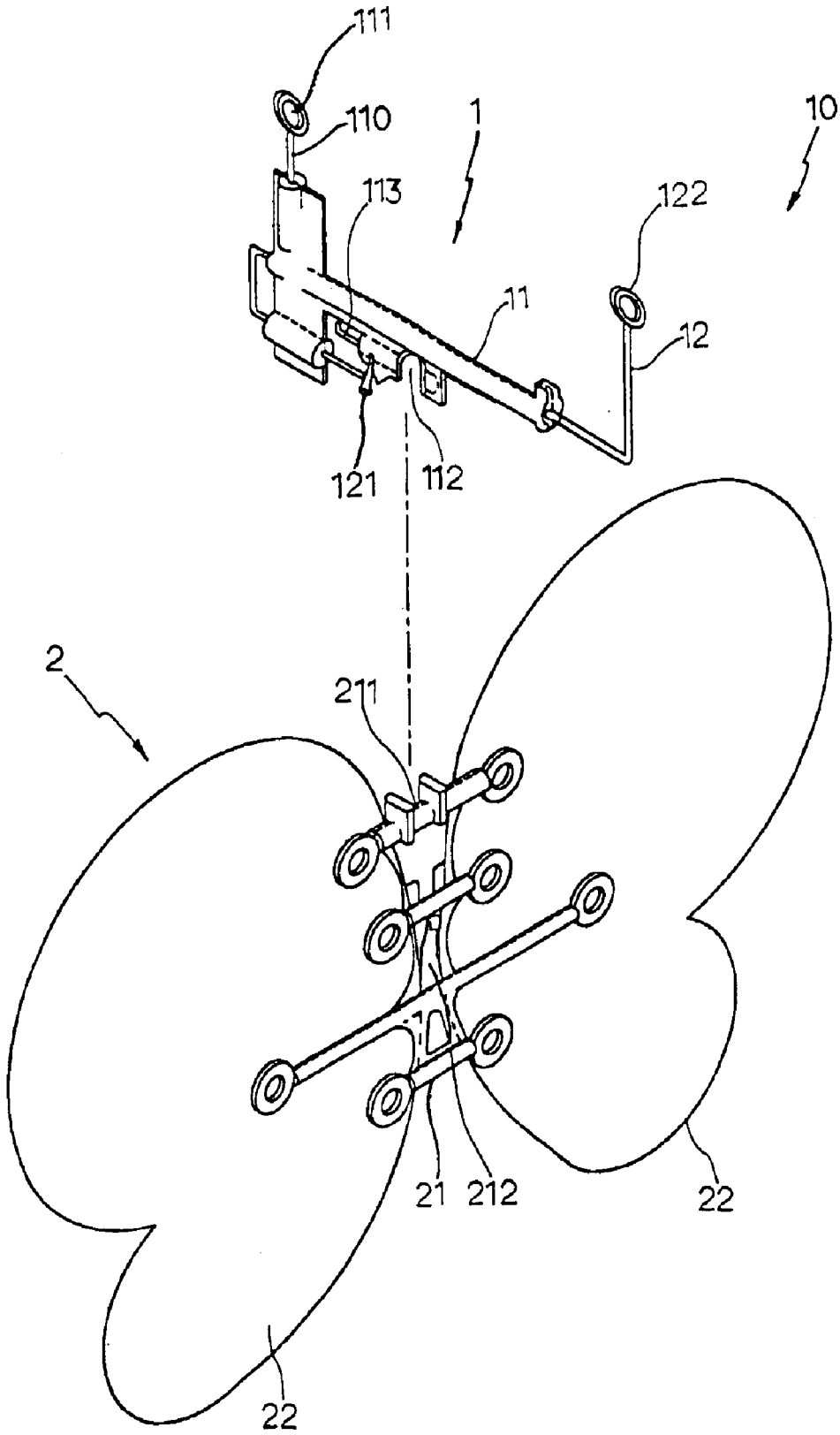
FIG. 1 is a perspective exploded view of a kite slider of a preferred embodiment in accordance with the present invention.
Figure 2:
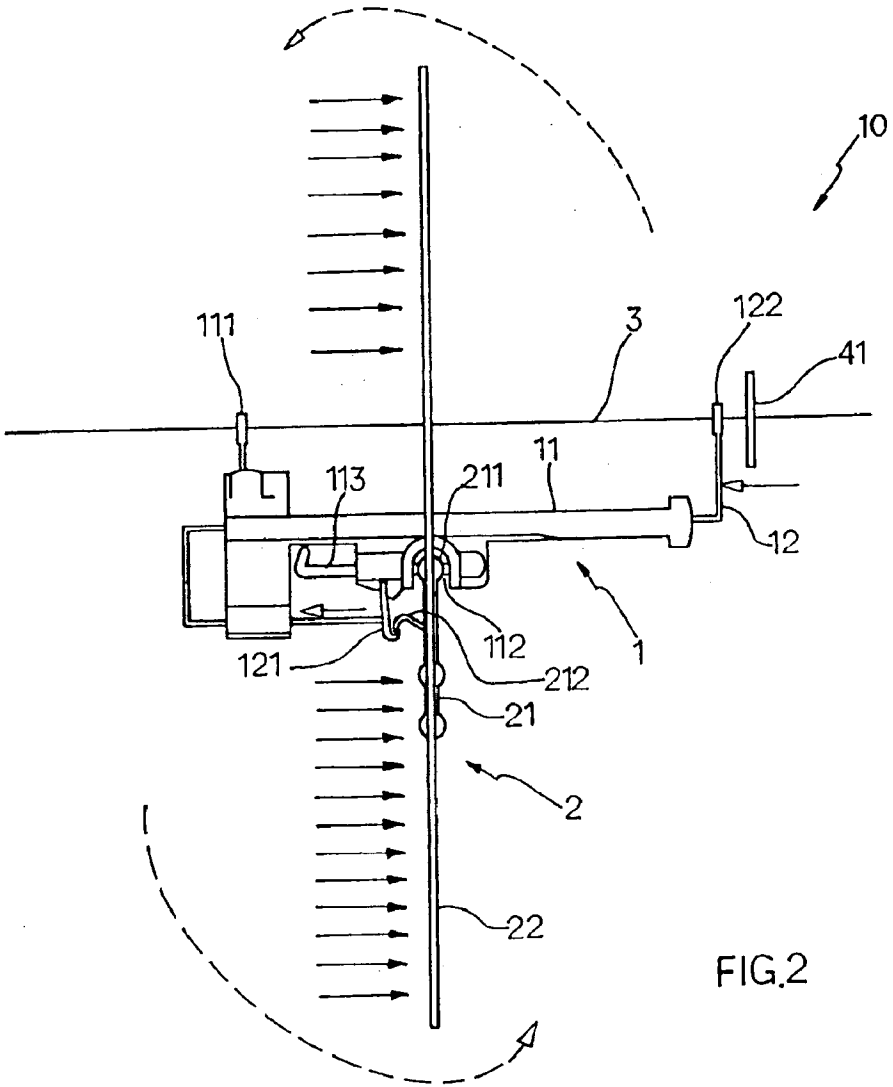
FIG. 2 is a schematic view illustrating a base frame perpendicular to a flying device of a preferred embodiment in accordance with the present invention.
Figure 3:
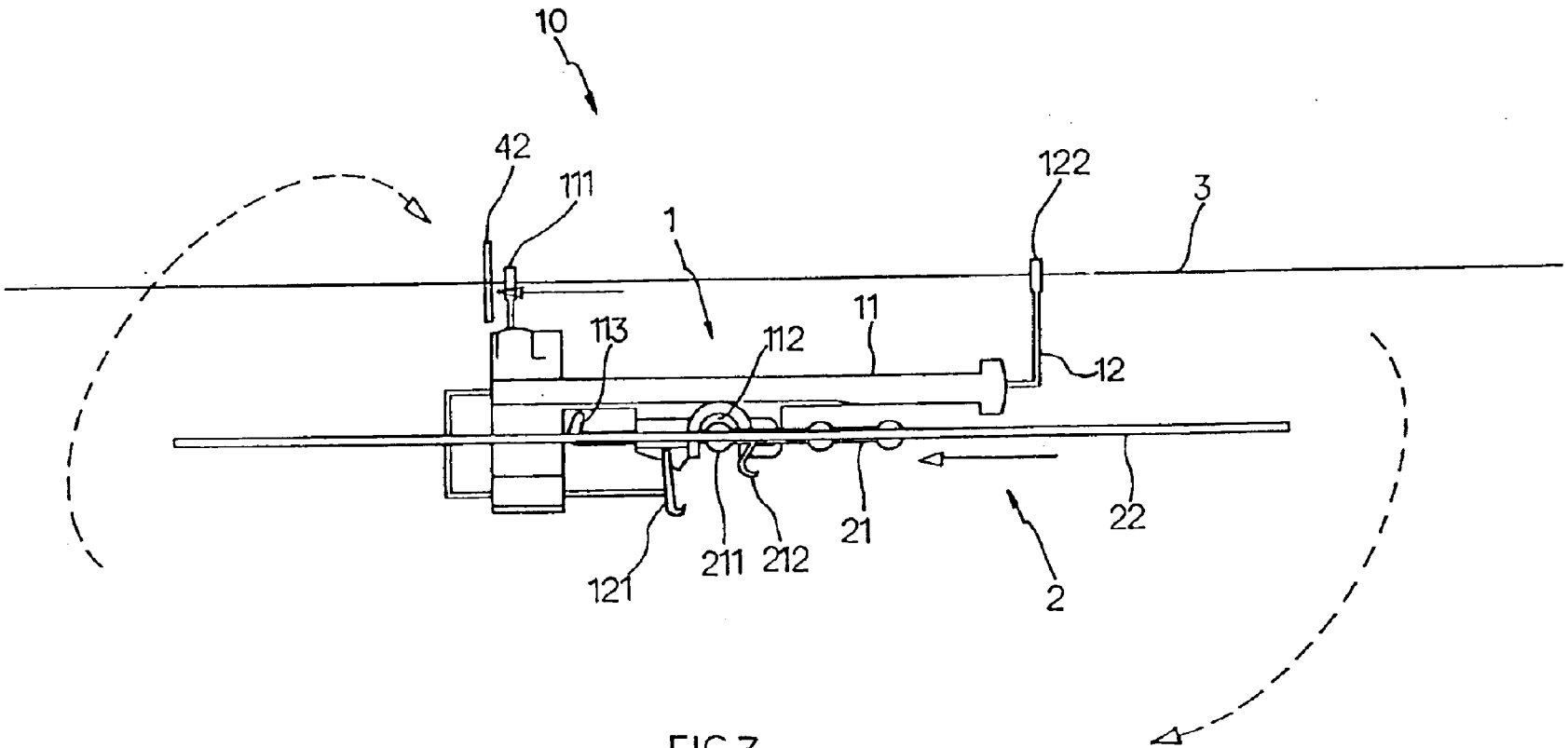
FIG. 3 is a schematic view illustrating a base frame parallel to a flying device of a preferred embodiment in accordance with the present invention.
Figure 4:
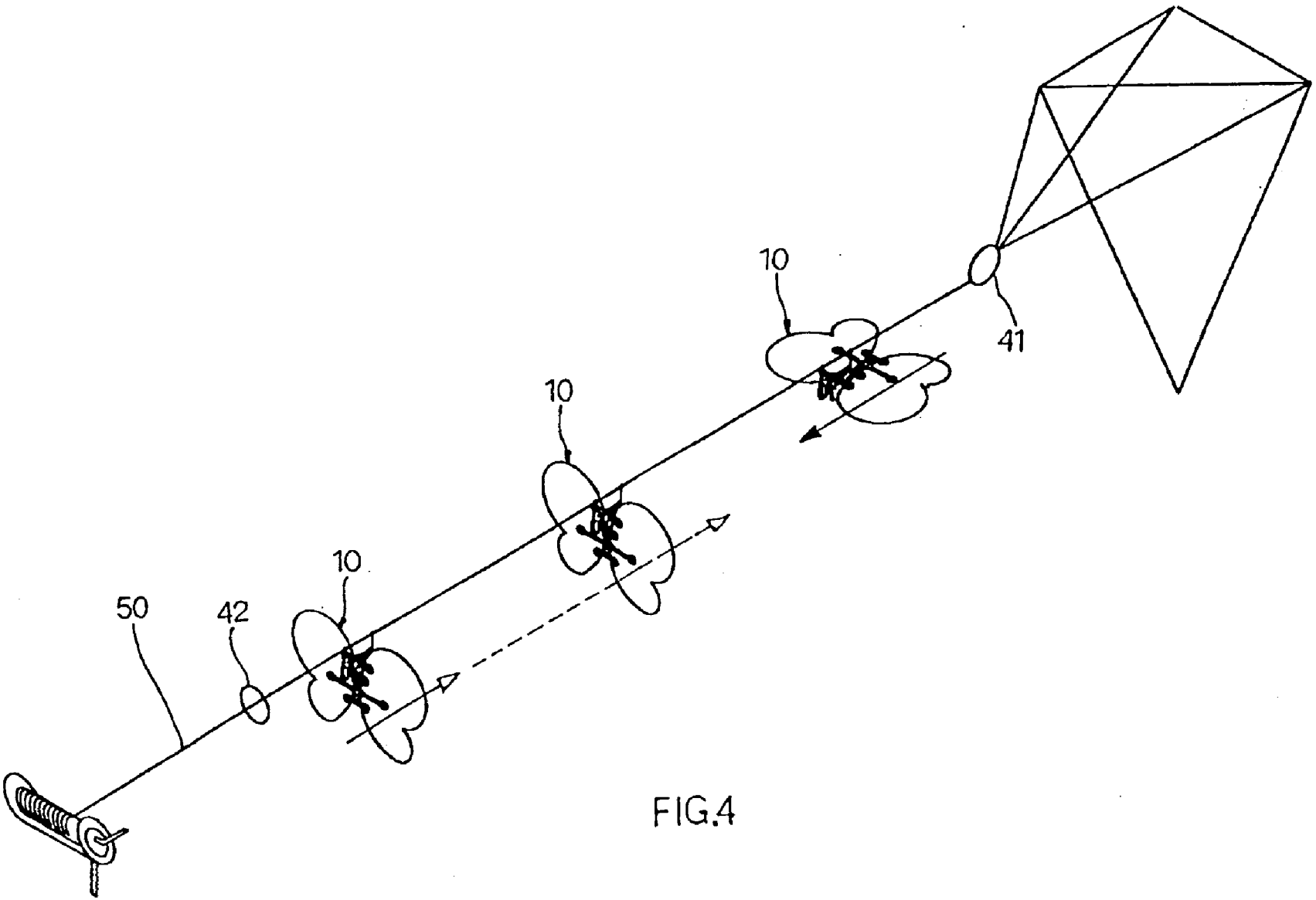
FIG. 4 is a schematic view illustrating a plurality of kite sliders moving along a kite string.

Referring to FIGS. 1 to 3, a kite slider 10 comprises a base frame 1 and a flying device 2 engaging with the base frame 1.

The base frame 1 has a hollow casing 11, a winding rod 12 inserted through the hollow casing 11, and a connection rod 110 connected to the winding rod 12 and extending outward from the hollow casing 11.

An end ring 111 is disposed on the connection rod 110.

A retainer device 121 is connected to the hollow casing 11 and a distal end of the winding rod 12.

A distal ring 122 is disposed on the winding rod 12.

The hollow casing 11 has a retaining notch 112 and a movable latch 113 disposed in the hollow casing 11 to be inserted through the retaining notch 112.

The flying device 2 has a main frame 21, a pair of leaf blades 22 connected to the main frame 21, a click frame 211 connected to the leaf blades 22, and a hooking device 212 disposed on the main frame 21.

The click frame 211 engages with the retaining notch 112 of the hollow casing 11.

Referring to FIGS. 1 to 4, a plurality of kite sliders 10 are disposed on a kite string 50. A blocking disk 41 is disposed on an end of the kite string 50. A blocking device 42 is disposed on a lower portion of the kite string 50.

The kite string 50 passes through the distal ring 122 and the end ring 111 of each kite slider 10.

Referring to FIG. 2 again, the base frame 1 is perpendicular to the flying device 2. The retainer device 121 engages with the hooking device 212. The kite slider 10 will move upward along the kite string 50 until the blocking disk 41 blocks the distal ring 122 of the kite slider 10 (not shown in the figure).

Then the winding rod 12 will move until the retainer device 121 disengages from the hooking device 212. The leaf blades 22 will be rotated until the base frame 1 is parallel to the flying device 2.

Referring to FIG. 3 again, the base frame 1 is parallel to the flying device 2. Then the kite slider 10 will move downward along the kite string 50 until the blocking device 42 blocks the end ring 111 of the kite slider 10 (not shown in the figure). The leaf blades 22 will be rotated until the base frame 1 is perpendicular to the flying device 2 and the retainer device 121 engages with the hooking device 212 again (not shown in the figure).

The present invention has the following advantages.

The kite slider will move upward along the kite string until the blocking disk blocks the distal ring of the kite slider. Then the kite slider will move downward.

The kite slider will move downward along the kite string until the blocking device blocks the end ring of the kite slider. Then the kite slider will move upward.

The kite slider is driven by the wind.

When the flying device 2 is perpendicular to the base frame 1, the wind will drive the kite slider to move upward along the kite string.

When the flying device 2 is parallel to the base frame 1, the wind will not drive the kite slider to move upward along the kite string.

Therefore, the kite slider will move along the kite string upward and downward.

A kite will carry a plurality of kite sliders to move along the kite string upward and downward. A user will watch the movement of the kite sliders and the flying of the kite at the same time.

The present invention is not limited to the above embodiment but various modification thereof may be made. Furthermore, various changes in form and detail may be made without departing from the scope of the present invention.

What is claimed is:

1. A kite slider comprising:

a base frame and a flying device engaging with the base frame, the base frame having a hollow casing, a winding rod inserted through the hollow casing, and a connectionrod connected to the winding rod and extending outward from the hollow casing, an end ring disposed on the connection rod, a retainer device connected to the hollow casing and a distal end of the winding rod, a distal ring disposed on the winding rod, the hollow casing having a retaining notch, the flying device having a main frame, a pair of leaf blades connected to the main frame, a click frame connected to the leaf blades, and a hooking device disposed on the main frame, and the click frame engaging with the retaining notch of the hollow casing.

2. The kite slider as claimed in claim 1, wherein a movable latch is disposed in the hollow casing to be inserted through the retaining notch.

* * * * *